US006063215A

United States Patent [19]

Harrington

[11] Patent Number: 6,063,215

[45] Date of Patent: May 16, 2000

[54] METHOD OF MANUFACTURING CASTING BELTS FOR USE IN THE CASTING OF METALS

[75] Inventor: Donald G. Harrington, Danville, Calif.

[73] Assignee: Kaiser Aluminum & Chemical Corporation, Pleasanton, Calif.

[21] Appl. No.: 08/853,804

[22] Filed: May 9, 1997

Related U.S. Application Data

[63] Continuation of application No. 08/543,445, Oct. 16, 1995, abandoned.

[51] Int. Cl.[7] ..... C21D 8/00; C21D 7/06; C21D 1/09

[52] U.S. Cl. ..... 148/622; 148/623; 148/661; 148/565

[58] Field of Search ..... 148/525, 565, 148/579, 661, 622, 623

[56] References Cited

U.S. PATENT DOCUMENTS

| | | | |
|---|---|---|---|
| 1,831,060 | 11/1931 | Drake . | |
| 3,193,888 | 7/1965 | Rochester | 22/57.4 |
| 3,345,738 | 10/1967 | Mizikar et al. | 29/528 |
| 3,346,037 | 10/1967 | Bungeroth | 164/273 |
| 3,455,371 | 7/1969 | Nichols et al. | 164/87 |
| 3,522,836 | 8/1970 | King et al. | 164/87 |
| 3,605,863 | 9/1971 | King | 164/156 |
| 3,789,909 | 2/1974 | Smith | 164/87 |
| 3,795,269 | 3/1974 | Leconte et al. | 164/73 |
| 3,861,450 | 1/1975 | Mobley et al. | 164/73 |
| 3,871,439 | 3/1975 | Maringer et al. | 164/87 |
| 3,937,270 | 2/1976 | Hazelett et al. | 164/50 |
| 3,976,117 | 8/1976 | Olsson | 164/48 |
| 4,002,197 | 1/1977 | Hazelett et al. | 164/250 |
| 4,088,295 | 5/1978 | Medovar et al. | 249/79 |
| 4,202,404 | 5/1980 | Carlson | 164/423 |
| 4,250,950 | 2/1981 | Buxmann et al. | 164/430 |
| 4,343,347 | 8/1982 | Liebermann et al. | 164/463 |
| 4,408,653 | 10/1983 | Nienart et al. | 164/463 |
| 4,415,016 | 11/1983 | McLane et al. | 164/429 |

(List continued on next page.)

FOREIGN PATENT DOCUMENTS

| | | |
|---|---|---|
| 1087954 | 6/1994 | China . |
| 0181566 | 5/1988 | European Pat. Off. . |
| 181566 | 5/1988 | European Pat. Off. . |
| PCT/JP92/ 00006 | 1/1992 | European Pat. Off. . |
| 577833 | 7/1992 | European Pat. Off. . |
| 1364717 | 5/1963 | France . |
| 61-073837 | 4/1986 | Japan . |
| 1-156428 | 6/1989 | Japan . |

OTHER PUBLICATIONS

Wang Deming, Abstract of Chinese Patent, CN 1087954, Method of Manufacturing of Water–Hardened Steel Conveyer Belt, Jun. 15, 1994.

Sato Kazuo, Patent Abstracts of Japan, JP1156428, Manufacture of Steel Belt, Jun. 20, 1989.

Yoshida Miroshi, Patent Abstracts of Japan, Heat Treatment of Cold–Finished Special Steel Strip, Apr. 16, 1986.

*Primary Examiner*—Deborah Yee
*Attorney, Agent, or Firm*—Rockey, Milnamow & Katz, Ltd.

[57] ABSTRACT

A belt for use in the casting of metals and a method for its manufacture in which a metal belt is first subjected to heat treatment, quenching and tempering to improve its strength and decrease its stretchability. Then the belt is treated to introduce surface irregularities to promote uniformity of heat transfer and to allow collection of surface gases and then the belt is subjected to further thermal treatment under controlled conditions to form an oxide layer thereon to minimize adhesion between the belt and the metal deposited thereon.

28 Claims, 3 Drawing Sheets

U.S. PATENT DOCUMENTS

| | | | |
|---|---|---|---|
| 4,489,772 | 12/1984 | McLane et al. | 164/423 |
| 4,561,487 | 12/1985 | Bedell | 164/253 |
| 4,588,015 | 5/1986 | Liebermann | 164/463 |
| 4,793,400 | 12/1988 | Wood | 164/121 |
| 4,865,117 | 9/1989 | Barlett et al. | 164/479 |
| 4,934,443 | 6/1990 | Honeycutt, III et al. | 164/479 |
| 4,945,974 | 8/1990 | Honeycutt, III | 164/479 |
| 4,954,974 | 9/1990 | Howell, IV et al. | 364/551.01 |
| 5,010,947 | 4/1991 | Yukumoto et al. | 164/428 |
| 5,391,856 | 2/1995 | Minamida et al. | 219/121.68 |
| 5,515,908 | 5/1996 | Harrington | 164/481 |
| 5,564,491 | 10/1996 | Harrington | 164/481 |

METHOD OF MANUFACTURING CASTING BELTS FOR USE IN THE CASTING OF METALS

This application is a continuation of Ser. No. 08/543,445 filed Oct. 16, 1995, now abandoned.

BACKGROUND OF THE INVENTION

This invention relates to belts for use in the casting of metals and a method for the manufacture of such belts, and more particularly to belts suitable for use in the high speed continuous casting of aluminum alloys and methods for the manufacture of such belts.

The continuous casting of thin metal strips is generally known in the prior art, but has not been widely employed. Prior processes for the continuous casting of aluminum alloys into thin strip form have been limited to a relatively smaller number of alloys and products. It is generally recognized that, as the alloy content of various aluminum alloys is increased, the surface quality of the alloy as cast deteriorates.

Relatively pure aluminum such as foil can be continuously strip cast on a commercial basis principally because of the low alloy content. Similarly, building products have likewise been continuously strip cast; the surface quality of those products is less critical than in may other aluminum products such as can stock.

One conventional strip casting device which has been used in the prior art is the twin belt strip casting machine in which two moving belts define between them a moving mold for the metal to be cast. Cooling of the belts is typically effected by contacting a cooling fluid with the side of the belt opposite the side in contact with the molten metal. As a result, the belt is subjected to high thermal gradients, the molten metal being in contact with one side of the belt and the water coolant in contact with the other. Such gradients, dynamically unstable, cause distortion in the belts, resulting in neither the upper nor lower belt remaining flat. Those conditions adversely affect the surface quality of the metal cast.

As a result, belt casting techniques have not received wide spread acceptance in the casting of alloys for surface-critical applications such as the manufacture of aluminum can stock. Various improvements have been proposed in the prior art, including techniques in which the belts are preheated as described in U.S. Pat. Nos. 3,937,270 and 4,002,197, continuously applied and removed parting layers as described in U.S. Pat. No. 3,795,269.

It has also been proposed to perform continuous strip casting in single drum casters. In such devices, a supply of molten metal is delivered to the surface of a rotating drum, which is internally water cooled, and the molten metal is dragged onto the surface of the drum to form a thin strip of metal which solidifies on contact with the surface of the drum. Such drum casting also tends to have surface quality problems and various attempts have been made at solving those problems. For example, U.S. Pat. Nos. 4,793,400 and 4,954,974 suggest that the surface quality of the metal being cast can be improved by grooving the surface of the drums. A somewhat different approach was taken in U.S. Pat. No. 4,934,443 in which the deposition of the molten metal onto the surface of the drum, which may be grooved, establishes a natural oxide to develop on the surface of the drum as a result of exposure to the heat from the melt and to the atmosphere. Forming grooves in belts is, however, substantially more difficult than forming grooves on the surfaces of drum caster; because of inherent variations in belt steering and thickness, it is often difficult to control the spacing and depth of the grooves to be formed.

Substantial improvements in the strip casting of metals such as aluminum alloys are described in pending application Ser. No. 173,663 filed Dec. 23, 1990, as well as co-pending application Ser. No. 184,581 filed Jan. 21, 1994 and Ser. No. 173,369 filed Dec. 23, 1993, the disclosures of which are incorporated herein by reference. In the strip casters described in the applications, the apparatus includes a pair of endless belts, each of which is carried by a pair of pulleys. The belts define a molding zone therebetween corresponding to the desired thickness of the aluminum strip being cast. Aluminum alloy is supplied to the molding zone and solidifies therein. To prevent the substantial thermal gradients encountered in prior art twin belt casters, the apparatus described cools each of the endless belts while they are out of contact with either the molten metal or the cast metal strip. While the strip casting technique described in the aforementioned application represents a dramatic improvement over the prior art, it imposes severe constraints on the nature of the belt to be used. The belt used in that apparatus may run under conditions of high tension. The bending stress induced as the belts turn around their supporting pulleys combined with the tension stress on the belt require particularly high tensile strengths. It is not uncommon for such belts to grow in length by as much as 12 inches during 20 minutes of cast time. It was also found that, as described in U.S. Pat. No. 4,934,443, an oxide layer does not form on the belt until after the belt has been in use for some period of time. As a result, there is a tendency for the aluminum to adhere to the surface of the belt in initial start-up casting operations. Thus, the strip casting as described in the foregoing application imposes demanding requirements in terms of the properties of the belts used in the casting process.

It is accordingly an object of the present invention to provide belts for use in the casting of metals, and particularly aluminum alloy, and a method for the manufacture of such belts would overcome the foregoing disadvantages.

It is a more specific object of the invention to provide belts for use in the continuous casting of metals such as aluminum alloy in which the yield strength is dramatically improved to reduce stretching in the belt under elevated temperature conditions, while at the same time treating the surface of the belt to reduce the tendency for adhesion between the belt and the metals being cast.

It is yet another object of the invention to provide a belt for use in the casting of metals in which surface irregularities are introduced to the surface of the belt in contact with the molten metal to improve heat transfer therebetween and to allow the escape of gases to improve the surface characteristics of the metal being cast.

These and other objects and advantages of the invention appear more fully hereinafter from a detailed description of the invention.

SUMMARY OF THE INVENTION

The concepts of the present invention reside in a belt for use in the casting of molten metals, and preferably aluminum alloy, and a method for manufacturing such belts in which the belts are subjected to three distinct thermal treatment steps. In the first thermal treatment step, the belt is heated to an elevated temperature sufficient to solution heat treat the belt and then quenched to increase its strength and to reduce the tendency of the belt to stretch.

Subsequently, the belts are temper heat treated to provide the desired strength levels.

In the most preferred embodiment of the invention, it is preferred that the solution heat treatment be carried in the presence of a controlled atmosphere to minimize surface oxidation on the belt. The controlled atmosphere which may be used in the most preferred embodiment of the invention can either be a vacuum or a non-oxidizing atmosphere as provided either by an inert gas or a reducing atmosphere such as that afforded by carbon monoxide.

In the preferred practice of the present invention, after the belt has been strengthened to increase its strength and hardness and reduce its stretchability, the belt is preferably treated to introduce to the surface coming in contact with the molten metal irregularities in the surface of the belt. As used herein, the term "irregularities" refers to and includes irregularities in the surface that serves to improve uniformity of heat transfer between the belt and the molten metal to be deposited thereon by providing cavities in which surface gases released may be collected or allowed to escape from between the belt and the molten metal deposited thereon. The surface irregularities used in the practice of the present invention may be in the form of grooves, dimples or any other pattern on the surface of the belt serving those two functions.

Once the belt has been treated to introduce the surface irregularities, the lands are polished to remove burrs and any surface oxides which may be formed. Thereafter, the belts are then subjected to a third heat treatment under controlled conditions of elevated temperature to oxidize the surface of the belt. The surface oxidation thus formed on the belt substantially minimizes the tendency of the molten metal or the solidified metal formed therefrom to adhere to the surface of the belt. For best results, the oxide must also have the desired thickness of 2 to 20 microns to allow high heat fluxes for rapid solidification.

Without limiting the invention as to theory, it is believed that, by controlling the conditions of temperature and time, it is possible to provide a more uniform oxidation layer than that achieved by the practice described in U.S. Pat. No. 4,934,443. In the latter, the oxidation layer formed on the belt must be formed by exposure to heat from the belt and to the atmosphere, conditions which vary with time. By pre-conditioning the belts with controlled time and temperature in the practice of this invention, it is possible to insure that the oxidation layer thus formed is substantially uniform across the surface of the belt prior to the start of casting.

Thus, the belt of the present invention has the properties necessary to allow reliable casting before the casting has begun. That insures that the belts of the invention have the capability of providing improved surface quality at the beginning of the casting operation without the tendency of the molten metal to adhere to the surface of the belt until the belt has become seasoned.

The belts employed in the practice of the present invention are preferably made of heat treatable steel. It will be understood, however, that other metal belts can likewise be used. Copper belts, for example, have been found to provide satisfactory results. The belts thus produced using the techniques of the present invention have been found to be highly suitable in the strip casting technique described in the foregoing co-pending application.

DETAILED DESCRIPTION OF THE INVENTION

Figure 1:
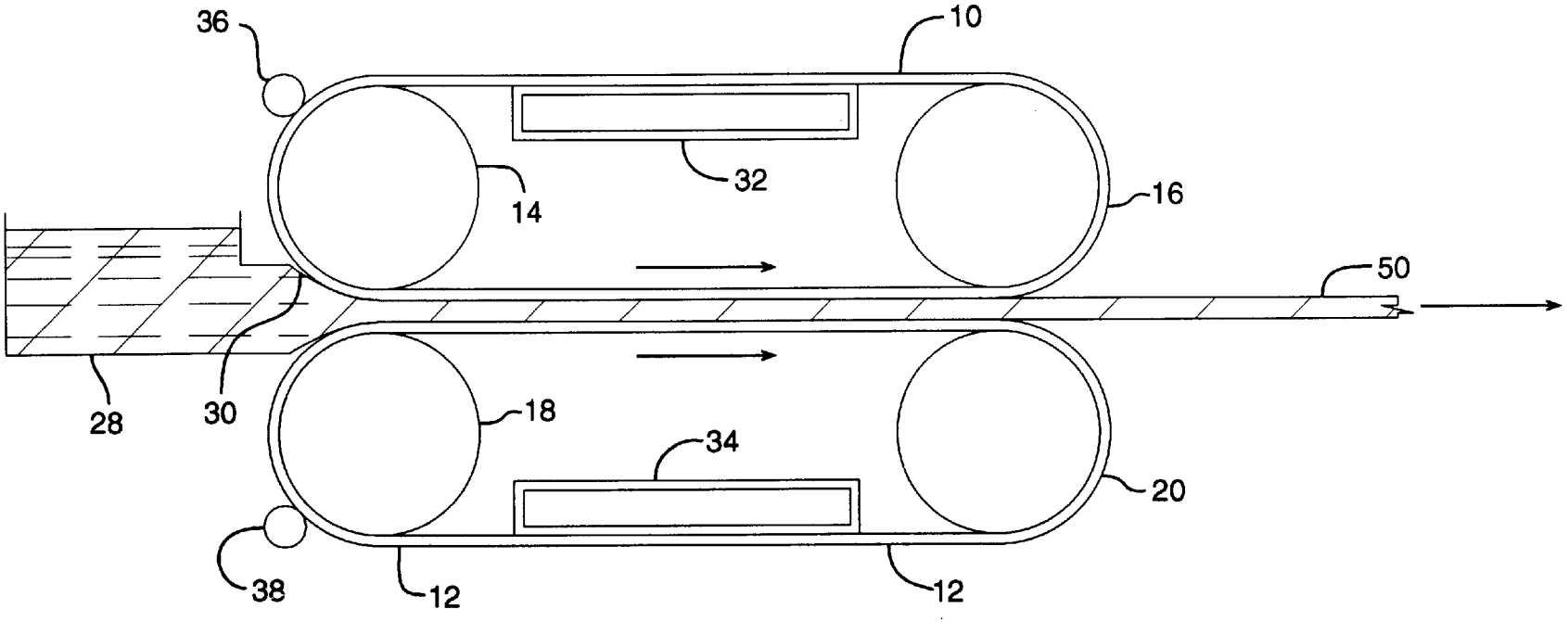
FIG. 1 is a schematic illustration of the casting apparatus in which the belts of the present invention may be used.

The belts of the present invention are preferably used in accordance with the strip cast technique in co-pending application Ser. No. 184,581. As shown, the apparatus includes a pair of endless belts 10 and 12 carried by a pair of upper pulleys 14 and 16 and a pair of corresponding lower pulleys 18 and 20. Each pulley is mounted for rotation, and is a suitable heat resistant pulley. Either or both of the upper pulleys 14 and 16 are driven by suitable motor means or like driving means not illustrated in the drawing for purposes of simplicity. The same is true for the lower pulleys 18 and 20. Each of the belts 10 and 12 is an endless belt and is preferably formed of a metal which forms an oxide having low reactivity with the aluminum being cast.

Figure 2:
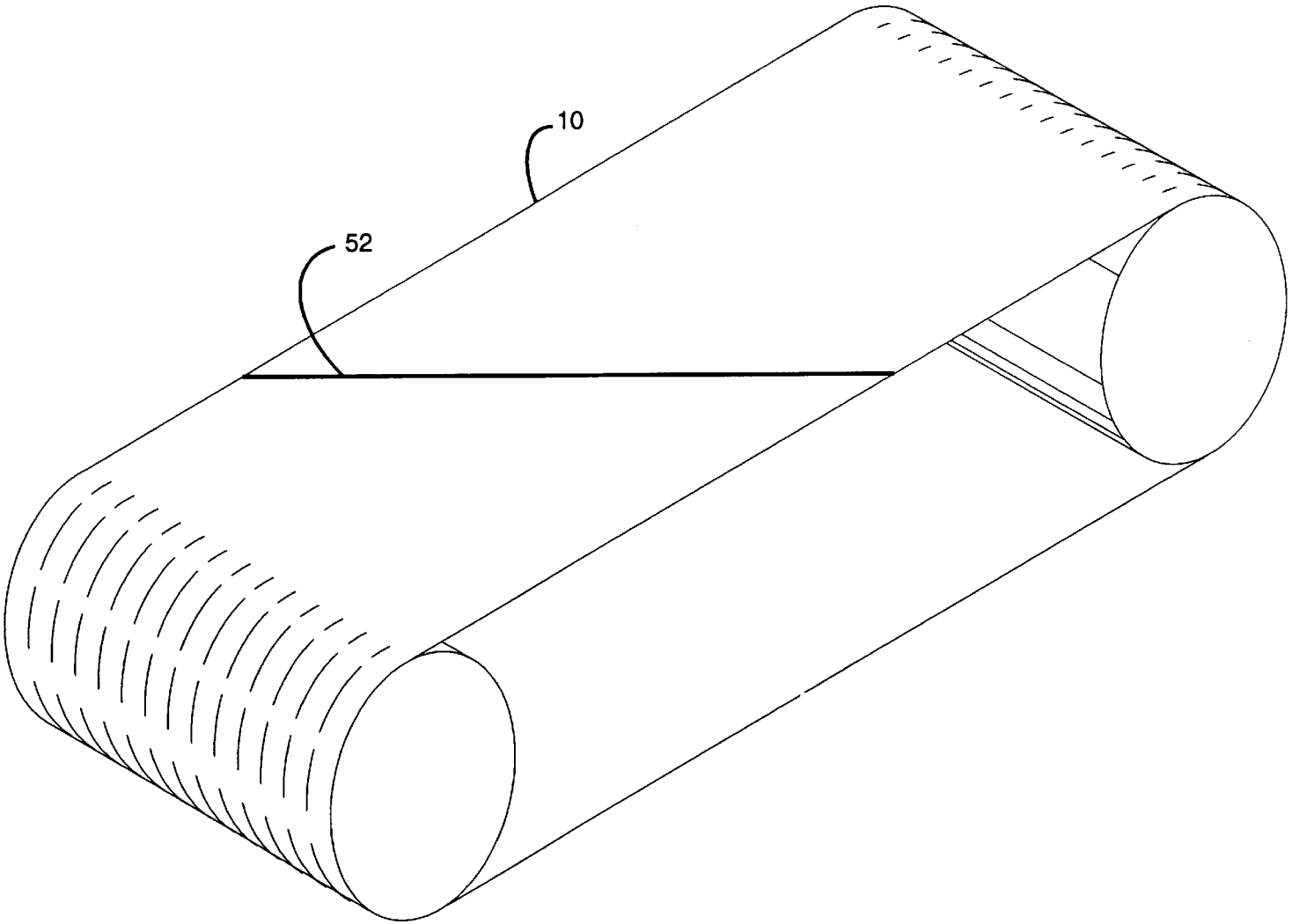
FIG. 2 illustrates how the belt is welded to form an endless belt of metal.

The pulleys are positioned, as illustrated in FIG. 2, one above the other with a molding gap therebetween corresponding to the desired thickness of the aluminum strip being cast.

Molten metal to be cast is supplied to the molding gap through suitable metal supply means such as a tundish 28. The inside of the tundish 28 corresponds substantially in width to the width of the belts 10 and 12 and includes a metal supply delivery casting nozzle 30 to deliver molten metal to the molding gap between the belts 10 and 12.

The casting apparatus also includes a pair of cooling means 32 and 34 positioned opposite that position of the endless belt in contact with the metal being cast in the molding gap between the belts. The cooling means 32 and 34 thus serve to cool belts 10 and 12, respectively, before they come into contact with the molten metal. In the preferred embodiment illustrated in FIG. 2, coolers 32 and 34 are positioned as shown on the return run of belts 10 and 12, respectively. In that embodiment, the cooling means 32 and 34 can be conventional cooling devices such as fluid nozzles positioned to spray a cooling fluid directly on the inside and/or outside of belts 10 and 12 to cool the belts through their thicknesses. Further details respecting the strip casting apparatus may be found in the foregoing co-pending applications.

In the preferred practice of the invention, the belts of the present invention are fabricated from heat treatable steel, and preferably carbon steels. A wide variety of carbon steels may be used in the practice of the invention, depending in part on the conditions to be used in the strip cast operation. Good results have been obtained using chromium-molybdenum steel from the 4100 series of AISI designation. In the practice of this invention particularly preferred is the steel bearing the AISI designation of 4130. Such steels generally contain chromium amounts ranging up to about 1%, molybdenum amounts ranging up to about 0.5% and carbon in an amount from 0.2 to 0.4% by weight. In addition to steel, use can also be made of various copper alloys well known to those skilled in the art.

In general, the steel belts of the present application are fabricated from a coil of the metal to be used in forming the belt. The coil is converted to endless belts by cutting to length and welding two ends of the belt each to the other in accordance with conventional techniques. As illustrated in FIG. 2 of the drawing, the belts 10 contain a weld 52. While the placement of the weld is not critical to the practice of the present invention, it is generally preferred that the weld extend transversely across the belt as shown in FIG. 2 at an acute angle from the perpendicular. In general, it is preferred that the weld be an angle from 10 to 45 degrees from the perpendicular.

Once the endless belt has been formed, it is then treated under non-oxidizing conditions at an elevated temperature and for time sufficient to increase the strength of the belt. The heat treating operation is carried out to increase the tensile strength to a level of at least 90,000 psi and preferably 100,000 to 150,000 psi, and a yield strength of at least 70,000 psi and preferably 80,000 to 120,000 psi. That can be accomplished by treating the belt to an elevated temperature sufficient to form a solid solution of carbon and iron. Such temperatures typically range from 1400 to 1800° F. The time for the heat treatment is not critical and should be sufficient to form a solid solution of carbon in iron. In general, the heating time will depend somewhat on the temperatures, but typically range from 0.1 to 10 hours.

As indicated previously, it is an important concept of the present invention that the heat treatment of the belt to increase its strength and reduce its tendency to stretch be carried out under non-oxidizing or reducing conditions. As will be appreciated by those skilled in the art, belts used for strip casting are typically formed of steel having a thickness ranging from 0.05 to 0.15 inches and heavy oxidation would adversely affect the subsequent surface texturing operation. For that reason, it is desirable, in the heat treatment step to increase the strength of the belt and decrease its tendency to stretch, that any oxidation be minimized.

After the belt has been solution heat treated to improve its strength and reduce its stretchability, it is quenched, preferably to a temperature below 700° F. It has been found that the quenching step should be carried out in a manner so as to substantially avoid distortion of the belt. Quenching in hot oil or hot salt has been found particularly effective in avoiding distortion of the belt during quenching.

Thereafter, the belt is subjected to a second heat treatment of tempering to achieve the desired strength level. Tempering of steel, copper and the like belts can be carried out under known tempering or aging conditions. Such tempering conditions preferably include temperatures ranging from 600 to 1400° F. for 0.1 to 5 hours, depending somewhat on whether the belt is formed of steel or copper.

Figure 3:
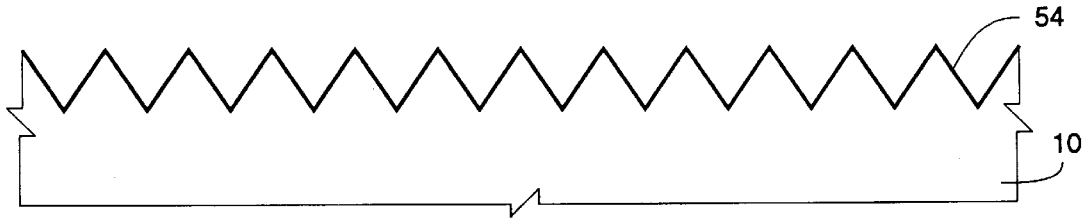
FIG. 3 is a side view showing the belt of the present invention which has been treated to introduce surface irregularities in the form of grooves.
Figure 4:
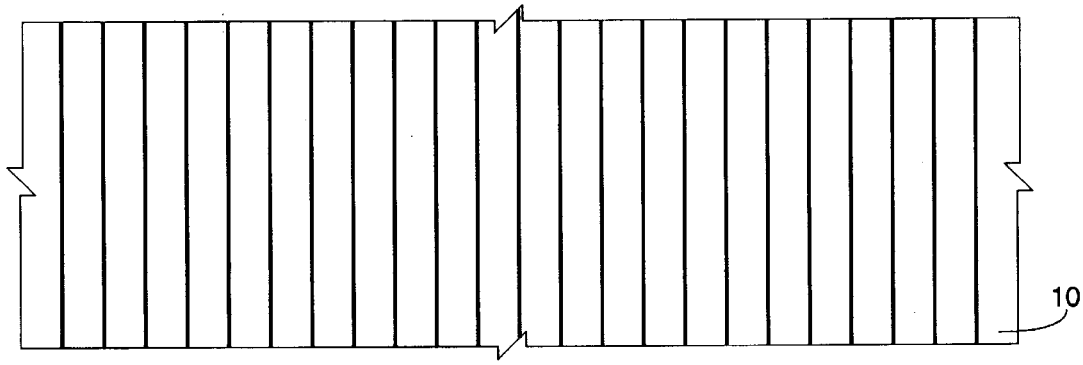
FIG. 4 is a plane view showing the grooved surface illustrated in FIG. 3.
Figure 5:
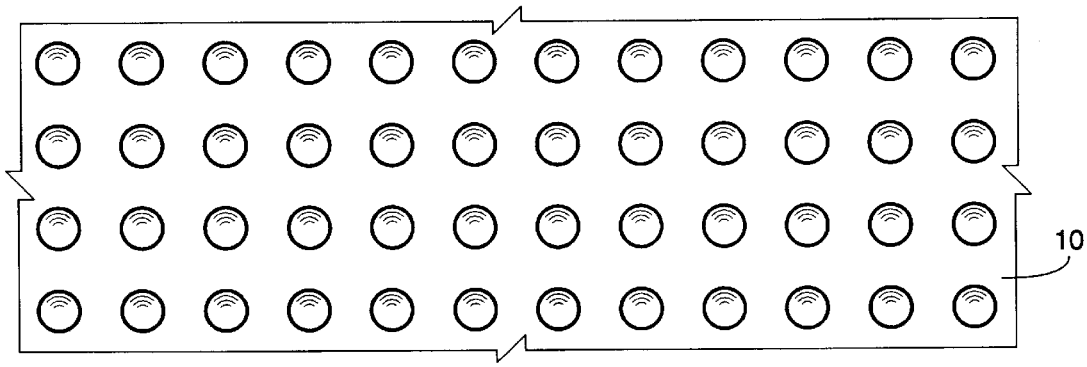
FIG. 5 is a plane view of a belt embodying the features of the present invention in which the surface irregularities are in the form of dimples.

Thereafter, it is treated to introduce surface irregularities on the surface which will come in contact with the molten metal. As shown in FIGS. 3 and 4, the belt 10 is preferably treated to introduce transversely extending grooves 54 on the surface of the belt. The formation of the grooves can be made by machining the belt in accordance with conventional techniques. Alternatively, it is also possible, and sometimes desirable, to introduce grooves to the surface of the belt by the use of a laser serving to cut the necessary grooves. The use of a laser can be particularly desirable because it can cut deeper and form more grooves per inch than typical tool machine methods. In addition, the use of a laser has the further advantage of effectively grooving the belt when hardened to a higher strength level than that possible using machine tool methods. Lasers also have the additional advantage of effectively grooving belts that are longer and wider than that possible with single tool machining methods; the latter are limited because of excessive tool wear.

It is also possible, and sometimes desirable, to employ, instead of grooves, a series of dimples 56 in the surface of the belt. The dimples likewise serve to increase the heat transfer between the molten metal and the metal to be cast as well as providing cavities to collect gases formed when the molten metal is deposited on the belt.

The dimensions of the surface irregularities are not critical to the practice of the present invention and can be varied within relatively wide ranges. It is frequently desirable that the surface irregularities be equally spaced each from the other and that they have a frequency ranging from 20 to 120 irregularities per inch. Typically, such grooves or such irregularities have a depth ranging from 1 to 40% of the thickness of the belt.

Once the surface irregularities are introduced to the surface of the belt, the belt is preferably polished to remove burrs and any surface oxides formed during the heat treatment on the surface thereof. Such polishing operations utilize progressively finer grit sizes and serve to flatten any sharp edges formed when the surface irregularities are introduced.

After the polishing step, the belt of the present invention is subjected to a second thermal treatment under controlled conditions of temperature to introduce or form a surface oxide layer on the belt. In general, it has been found that the belt can be thermally treated at a temperature ranging from 500 to 1000° F. for a period of 1 to 5 hours. Both air and combustion atmospheres have been found to provide good oxide thickness.

As will be appreciated by those skilled in the art, it is also possible to employ, in some instances, various chemicals which serve to reduce the tendency of the cast metal to adhere to the belt. Such chemical additives are themselves known to those skilled in the art.

The third thermal treatment thus serves to introduce to the surface of the belt a thin oxide layer thereon. It has been found that the then oxide layer, because it is far more uniform by reason of its having been preformed, is particularly effective in preventing adhesion of the metal to the surface of the belt, particularly at the start of the casting operation. Once the belt has been baked to introduce the oxide layer thereon, it is ready for use in the strip casting of the metal, and preferably in the strip casting of aluminum alloys.

Having described the past concept of the invention, reference is now made to the following example which is provided by way of illustration and not by way of limitation of the practice of the invention.

EXAMPLE

This example illustrates the preparation of a belt embodying the concepts of the present invention.

The belt coil stock used in the manufacture of the belt of this invention is a coil of AISI 4130 steel having a thickness of 0.08 inches which is welded at a 30' angle from the perpendicular to form an endless belt. The belt is then heat treated at a temperature of about 1600° F. for a period of three hours and quenched to harden the belt; it is then tempered at 1300° F. for 2 hours to provide a belt having a tensile strength of about 115,000 psi and a yield strength of 95,000 psi.

The belt is then subjected to mechanical grooving to introduce grooves having a frequency of 60 grooves per inch and a depth of 0.005. Thereafter, the belt is polished to a #320 finish.

Thereafter, the belt is baked in air for a period of two hours at a temperature of 900° F. It was found that the belt could be used for extended periods of time in the strip casting of aluminum alloys without sticking during starting.

It will be understood that various changes and modifications can be made in the details of procedure and use without parting from the spirit of the invention especially as defined in the following claims.

What is claimed is:

1. A method for the manufacture of casting belts for use in the casting of metals comprising the steps of:

(a) providing an endless metal belt;

(b) subjecting the belt to a heat treatment of solutionizing, quenching and tempering to improve its strength and decrease its stretchability;

(c) treating the belt to introduce to the outer surface irregularities in that surface to improve uniformity of heat transfer between the belt and molten metal deposited thereon and to allow the collection of surface gases from between the surface of the belt and the metal deposited thereon; and (d) subjecting the belt to a thermal treatment under controlled conditions of an elevated temperature to form on the surface of the belt an oxide layer having a thickness sufficient to substantially minimize adhesion between metals deposited thereon and the surface of the belt.

2. A method as defined in claim 1 which includes the step of polishing the belt after the irregularities are formed thereon.

3. A method as defined in claim 1 wherein the belt is formed of a metal containing carbon and the heat treatment is sufficient to dissolve the carbon in the metal to form a solid solution of carbon in the metal to strengthen the metal.

4. A method as defined in claim 1 wherein the belt is formed from a carbon steel.

5. A method as defined in claim 4 wherein the carbon steel is a chromium-molybdenum steel.

6. A method as defined in claim 5 wherein the steel contains up to about 1% chromium and up to about 0.5% molybdenum.

7. A method as defined in claim 4 wherein the steel contains from about 0.2% to about 0.4% by weight carbon.

8. A method as defined in claim 1 wherein the belt is heat treated at a temperature ranging from about 1200° to about 1800° F. and quenched.

9. A method as defined in claim 1 wherein the belt is heat treated for a time up to about 10 hours.

10. A method as defined in claim 1 wherein the belt, during heat treatment, is heated in the presence of a non-oxidizing atmosphere.

11. A method as defined in claim 1 wherein the belt, during heat treatment, is heated under vacuum.

12. A method as defined in claim 1 wherein the belt is quenched in hot oil or hot salt to avoid distortion of the belt.

13. A method as defined in claim 1 wherein the surface irregularities are in the form of grooves on the surface of the belt.

14. A method as defined in claim 1 wherein the surface irregularities are in the form of a pattern of dimples.

15. A method as defined in claim 1 wherein the surface irregularities are formed by mechanical processing.

16. A method as defined in claim 1 wherein the surface irregularities are formed by means of a laser.

17. A method as defined in claim 1 where in the thermal treatment is carried out at a temperature within the range of about 500° to 1000° F.

18. A method as defined in claim 1 wherein the oxide layer as thickness of about 2 to about 20 microns.

19. A method for the manufacture of casting belts for use in the casting of metals comprising the steps of:

(a) providing an endless metal belt which has been treated to improve its strength and decrease its stretchability;

(b) treating the belt to introduce to the outer surface irregularities in that surface to improve uniformity of heat transfer between the belt and molten metal deposited thereon and to allow the collection of surface gases from between the surface of the belt and the metal deposited thereon; and (c) subjecting the belt to a thermal treatment under controlled conditions of an elevated temperature to form on the surface of the belt an oxide layer having a thickness sufficient to substantially minimize adhesion between metals deposited thereon and the surface of the belt.

20. A method as defined in claim 19 which includes the step of polishing the belt after the irregularities are formed thereon.

21. A method as defined in claim 19 wherein the belt is formed from a carbon steel.

22. A method as defined in claim 21 wherein the carbon steel is a chromium-molybdenum steel.

23. A method as defined in claim 19 wherein the surface irregularities are in the form of grooves on the surface of the belt.

24. A method as defined in claim 19 wherein the surface irregularities are in the form of a pattern of dimples.

25. A method as defined in claim 19 wherein the surface irregularities are formed by mechanical processing.

26. A method as defined in claim 19 wherein the surface irregularities are formed by means of a laser.

27. A method as defined in claim 19 wherein the thermal treatment is carried out at a temperature within the range of about 500° to 1000° F.

28. A method as defined in claim 19 wherein the oxide layer as thickness of about 2 to about 20 microns.

* * * * *